US005654691A

United States Patent [19]

Wang

[11] Patent Number: 5,654,691

[45] Date of Patent: Aug. 5, 1997

[54] AUXILIARY BACKUP DEVICE OF BURGLARY ALARM SYSTEM

[76] Inventor: Randall Wang, 5209 N. Tyler Ave., Temple City, Calif. 91780

[21] Appl. No.: 439,851

[22] Filed: May 12, 1995

[51] Int. Cl.[6] ..... G08B 29/00

[52] U.S. Cl. ..... 340/507; 340/506; 340/514; 340/524; 340/292; 340/333; 364/184; 364/187

[58] Field of Search ..... 340/506, 507, 340/514, 521, 524, 292, 693, 333; 364/184, 187

[56] References Cited

U.S. PATENT DOCUMENTS

| | | | |
|---|---|---|---|
| 4,698,621 | 10/1987 | Masot | 340/693 |
| 5,296,750 | 3/1994 | Bozeman | 340/507 |
| 5,412,542 | 5/1995 | Maudy | 362/20 |

*Primary Examiner*—Thomas Mullen
*Assistant Examiner*—Daryl C. Pope
*Attorney, Agent, or Firm*—David & Raymond; Raymond Y. Chan

[57] ABSTRACT

The present invention provides an auxiliary backup device of burglary alarm system, connected with an alarm output and an auxiliary power output of a burglary control panel and an alarm device, comprises in combination an electrical circuit having a relay means and a DC power source. The relay means comprises a diode connected in parallel with an operating coil which induces a normally opened switch and also a normally closed switch. The two terminals of the diode are connected to the auxiliary power output of the control panel. The normally opened switch is coupled in series with the alarm output of the control panel and the input of the alarm device, such as an audible and visual warning devices. The output of the DC power source is connected in series with the normally closed switch and the input of the alarm device. Accordingly, when the control panel works normally that the voltage of the auxiliary power output of the control panel is high, the normally opened switch is induced to close and the normally closed switch is induced to open. Thus, the alarm output of the control panel is connected directly to the input of the alarm device. If the control panel and wiring are vandalized, the auxiliary power output losses its voltage or power. Then, the normally opened switch open and the normally closed switch close. At that time, the DC power source energizes the alarm device.

7 Claims, 5 Drawing Sheets

AUXILIARY BACKUP DEVICE OF BURGLARY ALARM SYSTEM

BACKGROUND OF THE PRESENT INVENTION

The present invention relates to burglary alarm system, and more particularly to an auxiliary backup device of burglary alarm system which is connected to a burglary alarm control panel and an audible and/or visual alarm device. The auxiliary backup device of burglary alarm system can detect the interruption of the control unit and then activate the audible and/or visual alarm device, thus deleting and preventing further damage from the intruder.

Various burglary alarm systems are commonly installed in supermarkets, department stores, companies, offices, banks, and residences for burglary preventing and security purposes. The practical factors to be considered during the development and design of burglary alarm system are unique features, practical functions, easy installation, high technology, low cost, and convenient operation. Traditional burglary alarm system consists of burglary alarm control, access control, audible and visual alarm device, etc. in order to achieve better security.

In fact, no matter how integrated and intelligent the traditional burglary alarm systems are, they can be easily destroyed to lose its efficacy by a thief who is acquainted with the burglary alarm system. Since all appliances of the burglary alarm system demand on the power output of the burglary control panel, wires are linked from the control panel to each appliance respectively, as shown in FIG. 1. Furthermore, the burglary control panel is installed at a predetermined location in house, such as in closet, storageroom, basement, attic, or near the entrance or exit. Although the burglary alarm system will be activated when burglars break in, experienced burglars can reach the control panel within a very short time to damage the control panel and cut all the wires connected from the control panel immediately. Once the control panel and wiring are vandalized by the intruder, the whole burglary alaem system is de-energized and loses its function and efficacy due to power lost.

To some more skillful burglars, there is a more simple way to achieve an power lost condition that de-engerizes the whole burglary alarm system by burning the fuses in the control panel. Since the motion detectors and glass break detectors of the burglary alarm system are connected to the power source and located at those obvious places (such as the edge of door and window), burglars can simply short the power wires to burn out the fuses of control panel. Furthermore, the burglars can break or drill a hole on the window in order to reach the motion or glass break detectors and short the power wires immediately for burning the fuses. Thus, the whole burglary alarm system is de-energized and loses its function and efficacy.

SUMMARY OF THE PRESENT INVENTION

The main object of the present invention is to provide an auxiliary backup device of burglary alarm system, which can monitor the voltage of the auxiliary power output from an burglary control panel. When the control panel and wiring are damaged, the auxiliary backup device will detect the interruption of the auxiliary power voltage and energize the output of an alarm device consisting audible and/or visual alarm to defer and prevent further damage from the intruder by an easy and economic way.

Another object of the present invention is to provide an auxiliary backup device of burglary alarm system, which is disposed in a standard electrical one-gung box and can be installed in any concealed place, such as in the ceiling, within a cabinet, or feigning to be a fake socket on wall.

Accordingly, an auxiliary backup device, connected with an alarm output and an auxiliary power output of a burglary control panel and an alarm device, comprises in combination an electrical circuit having a relay means and a DC power source. The relay means comprises an operating coil which induces a normally opened switch and also a normally closed switch. The two terminals of the operating coil are connected to the auxiliary power output of the control panel. The normally opened switch is coupled in series with the alarm output of the control panel and the input of the alarm device, such as an audible and visual devices. The output of the DC power source is connected in series with the normally closed switch and the input of the alarm device. Accordingly, when the control panel works normally that the voltage of the auxiliary power output of the control panel is high (11–14 volt.), the normally opened switch is induced to close and the normally closed switch is induced to open. Thus, the alarm output of the control panel is connected directly to the input of the alarm device. If the control panel and wiring are vandalized, the auxiliary power output losses its voltage or power. Then, the normally opened switch and the normally closed switch return to their open and close positions respectively. At that time, the DC power source will energize the alarm device.

DETAILED DESCRIPTION OF THE PREFERRED EMBODIMENT

Figure 1:
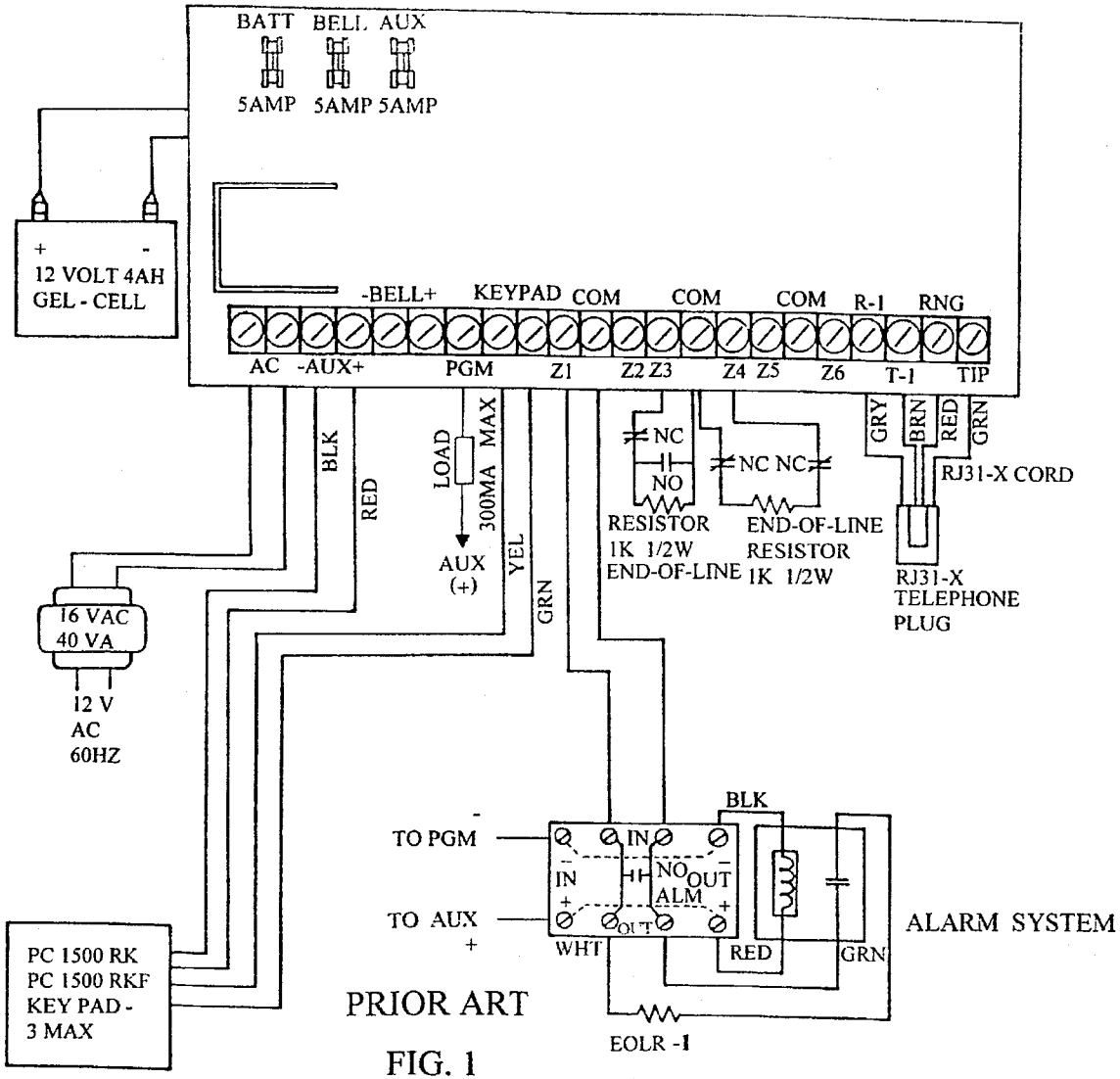
PRIOR ART FIG. 1
FIG. 1 is a schematic view of a traditional burglary control panel.
Figure 2:
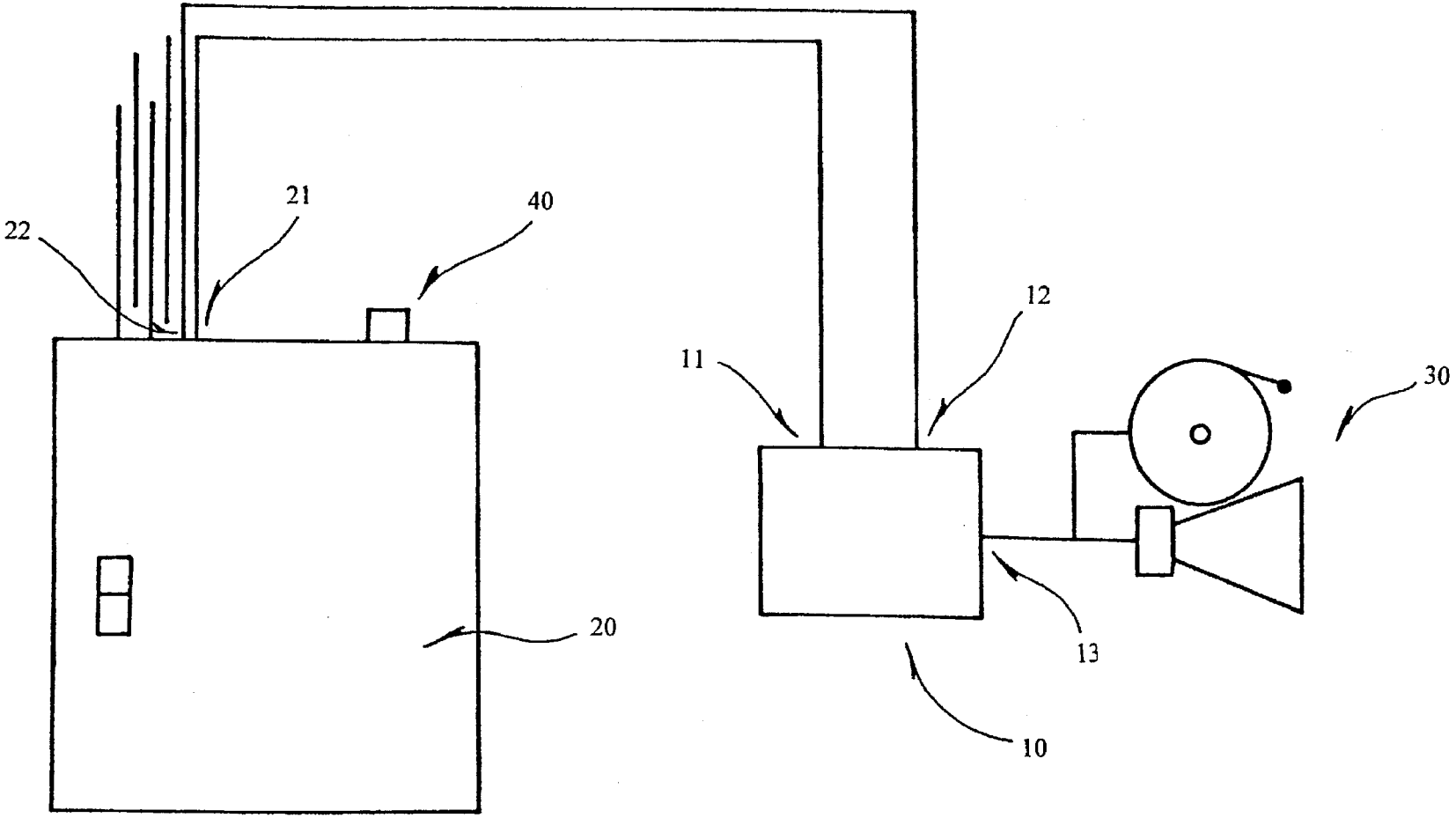
FIG. 2 is a schematic block diagram, in perspective of a traditional burglary control panel equipped with an embodiment of the present invention.

FIG. 2 illustrates an auxiliary backup device of burglary alarm system. The auxiliary backup device 10 has a power input 11, an alarm input 12, and an alarm output 13. The power input 11 is connected to an auxiliary power output 21 or a 12 V DC output of a burglary control panel 20 (as shown in FIG. 1) by two conductor cables. The alarm input 12 is connected to the alarm output 22, such as the BELL or SIREN terminal of the control panel 20 (as shown in FIG. 1) by two conductor cables. The alarm output 13 is connected to an input of an alarm device 30. The alarm device 30 is an audible and/or visible warning device which consists of siren, bell, horn, buzzer, chime, sounder, speaker, strobe light, warning light, or warning lamp.

Figure 3:
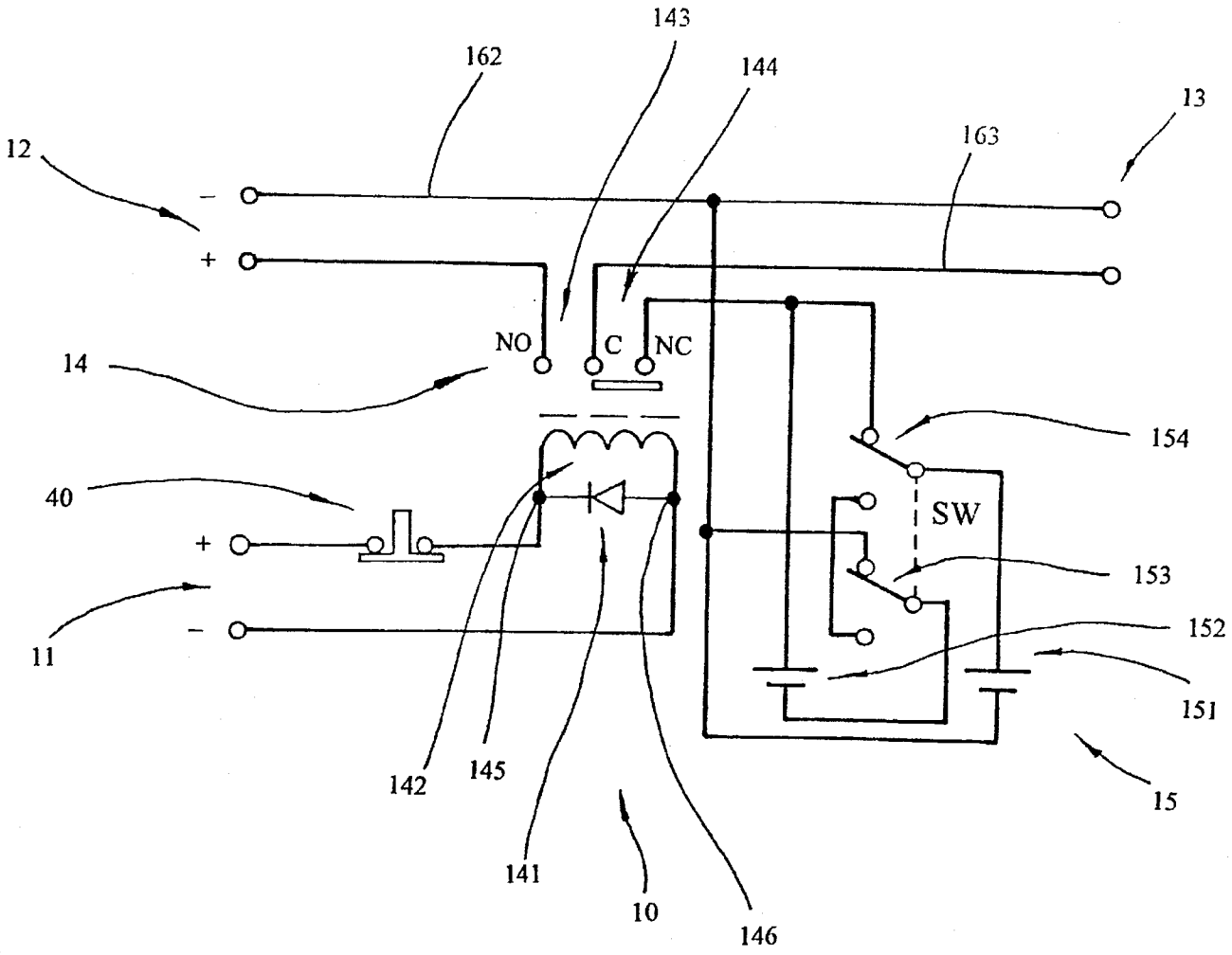
FIG. 3 is an electrical circuit diagram of an auxiliary backup device of the above embodiment of the present invention.

Referring to FIG. 3, the auxiliary backup device 10 further comprises in combination an electrical circuit having a relay means 14 and a DC power source 15. The relay means 14 comprises a diode 141 connected in parallel with an operating coil 142 which induces a normally opened switch 143 and a normally closed switch 144. The two terminals 145 and 146 of the operating coil 142 are connected to the power input 11 of which the two input terminals are coupled to the two output terminals of the auxiliary power output 21 of the control panel 20. The normally opened switch 143 has a normally opened terminal NO and a common terminal C. The normally closed switch 144 composes of the common terminal C and a normally closed terminal NC. The diode 141 can reduce the interference of its adjacent circuit for protecting the system.

The normally opened switch 143 is connected in series with the alarm input 12 of which the two input terminals are connected to the two output terminals of the alarm output 22 of the control panel 20 and the input of the alarm device 30. The output of the DC power source is connected in series with the normally closed switch 144 and the input of the alarm device 30. Under this arrangment, the negative terminal of the alarm input 12 is connected with the negative terminal of the alarm output 13 by an electric wire 161. The positive terminal of the alarm input 12 is connected to the normally opened terminal NO by a connecting wire 162. The positive terminal of the alarm output 13 is connected m the common terminal C by a common wire 163. The DC power source 15 has an output connected to the normally closed terminal NC and an input connected to the electric wire 161. Accordingly, when the control panel 20 works normally that the voltage of the auxiliary power output of the control panel 20 is high, the normally opened switch 143 is induced to close and the normally dosed switch 144 is induced to open. Thus, the alarm output of the control panel 20 is directly connected to the input of the alarm device 30. If the control panel 20 and wiring are vandalized, the auxiliary power output losses its voltage or power. Then, the normally opened switch 143 is opened and the normally closed switch 144 is closed. The DC power source 15 energizes the alarm device 20.

The DC power source 15 pursuant to the present embodiment comprises two 9 V batteries 151, 152 and a power controlling switch device SW which comprises two high-normal switches 153, 154. The first battery 151 has a positive pole connected to the wire 161 and a normal terminal of the first switch 153, and a negative pole connected to the second switch 154. The second battery 152 has a position pole connected to a normal terminal of the second switch 154 which is connected to the normally closed terminal NC of the normally closed switch 144. The second battery 152 has a negative pole connected to the first switch 153. The high terminal of the first switch 153 is connected to the high terminal of the second switch 154. In normal situation, the two batteries do not supply power, and the alarm device 30 is powered by the control panel 20. When the auxiliary power is interrupted, the two batteries 151, 152 are connected to the alarm output 13 and supply voltage power to the alarm device 30. The batteries 151, 152 should be able to hold 3 to 10 years of service life under normal situation and 5 to 50 minutes under alarm condition depending on the load of the output, manufacturer, and battery quantity.

When the power controlling switch device SW, that is the two high-normal switches 153, 154, has switched to normal, the two batteries 151, 152 are connected in parallel and their voltage output is normal and the two batteries 151, 152 last longer. When the power controlling switch device SW, that is the two high-normal switches 153, 154, has switched to high, the two batteries 151, 152 are connected in series and their voltage output becomes high and the batteries 151, 152 discharge more quickly. Thus, the output strength of the DC power source 15 can be selected by setting the power controlling switch device SW to normal or high position. In normal position, when the auxiliary backup device is in alarm, the output power normally can last for 10 to 20 minutes for using one battery and 20 to 50 minutes for using two batteries. In high position, when the auxiliary backup device is in alarm, the output power will be more powerful, but the batteries will be discharged sooner by 5 to 20 minutes.

Figure 4:
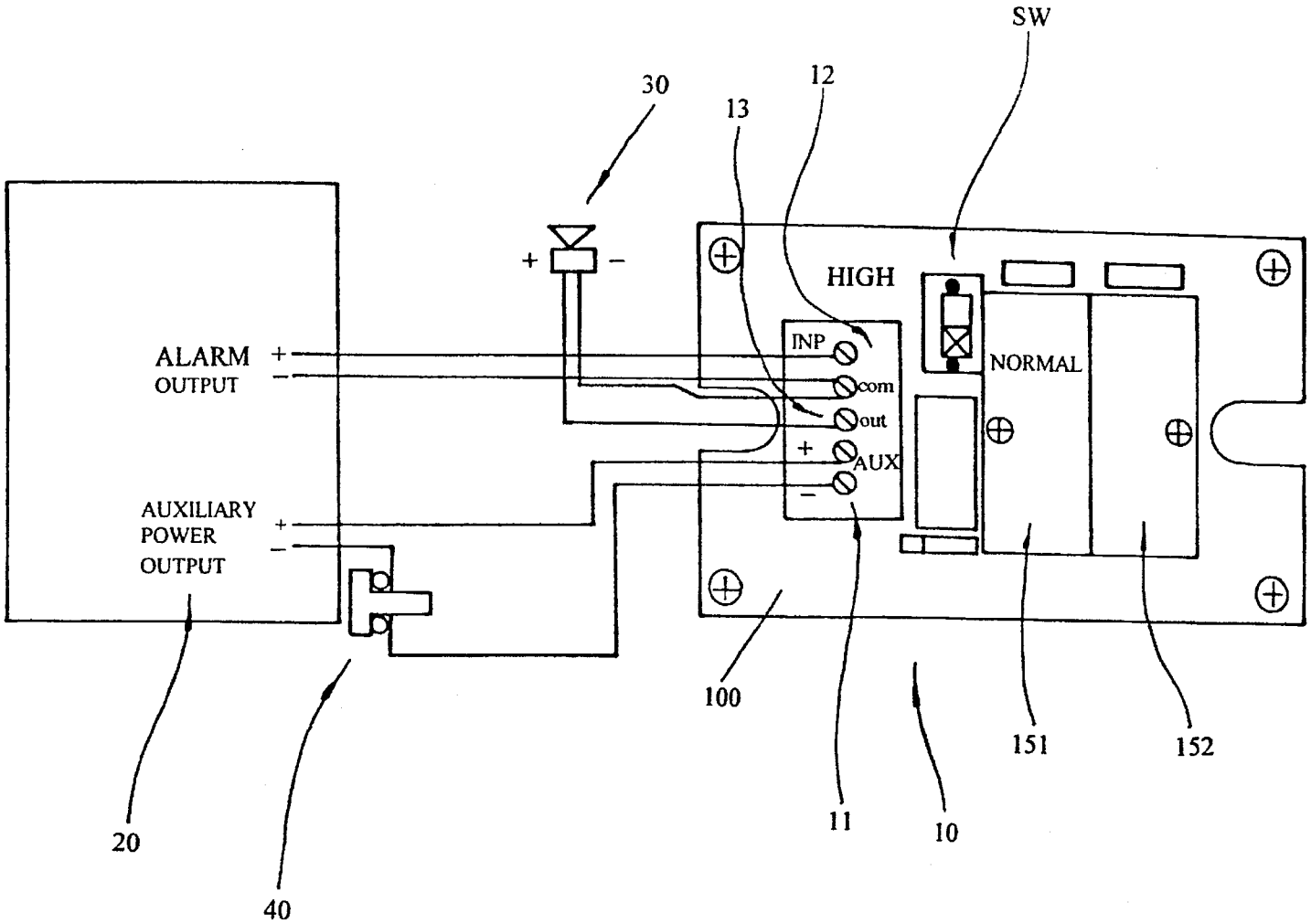
FIG. 4 is an schematic diagram of an auxiliary backup alarm device equipped with the burglary control panel and the alarm device of the above embodiment of the present invention, wherein the auxiliary backup device is installed in a standard electrical one-gung box.

A normally closed test switch 40, as shown in FIG. 2 to 5, is connected between the power output 11 and the relay means 14, and is mounted on the control panel 20 for the user to test the auxiliary backup device's operation and the batteries. As shown in FIG. 4, the electrical circuit of the auxiliary backup device 10 can be disposed in a standard electrical one-gung box 100 or the like, such as a standard one-gung ring (not shown in the Figure). The auxiliary backup device installed in the standard electrical one-gung box 100 can be mounted in a concealed place, such as in the ceiling, within a cabinet, or feigning to be a fake socket on wall, that is difficult for the burglary or intruder to discover and reach.

Referring to FIG. 3 and 4, to install the auxiliary backup device 10, the user must follow the following steps: (1) Disconnect the AC and battery powers first. (2) Then, connect the positive and negative AUX terminals of the power input 11 of the auxiliary backup device 10 to the auxiliary power output or any 12 V DC power output of the control panel 20. (3) Connect the normally closed test switch 40 in serial. (4) Connect the INP terminal of the alarm input 12 of the auxiliary backup device 10 to the positive terminal of the alarm output, such as the BELL or SEREN positive terminal (as shown in FIG. 1), of the control panel 20 and the COM terminal of the alarm input 12 of the auxiliary backup device 20 to the negative terminal of the alarm output, such as the BELL or SEREN negative terminal, of the control panel 20. (5) Connect the two terminals, the OUT and COM terminals, of the alarm output 13 to the positive and negative terminals of all appliances of the alarm device 30. (6) Select the output strength by setting the high-normal switch device SW to normal or high position.

Figure 5:
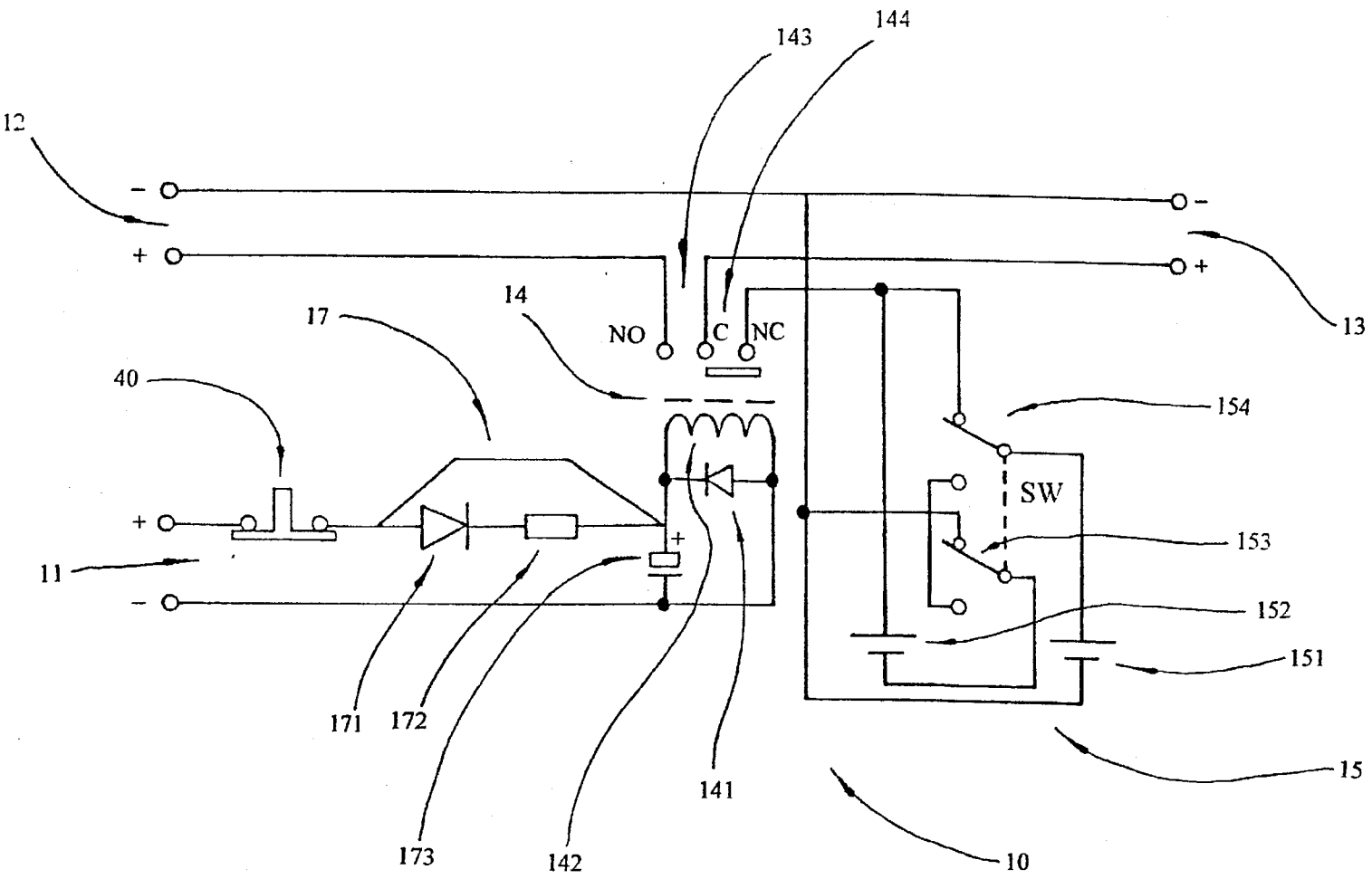
FIG. 5 is an electrical circuit diagram of an auxiliary backup device, connected with a jumper circuit for adapting 24 DC or AC power supply, of another embodiment of the present invention.

Referring to FIG. 5, when a 24 V DC or AC power output is used from the control panel 10, a jumper circuit 17 is connected in series with the test switch 40. The jumper circuit 17 comprises a jumper diode 171 and a 0.39K resistor 172 connected in serial, a capacitor 173 (50–100μ/25–50 V) connected in parallel with the power input 11. By utilizing the jumper circuit 17, the auxiliary backup device is adapted to 24 V DC or AC power supply. In accordance with the embodiment shown in FIG. 5, the jumper circuit 17 further comprises a jumper circuit wire 174 connected in parallel with the jumper diode 171 and resistor 172. Thus, if the input power is 24 V DC or AC, cut the jumper circuit wire 174 of the jumper circuit 17. If the input power is 12 V DC, the user needn't to cut the jumper circuit wire 174 of the jumper circuit 17.

By utilizing the test switch 40, as shown in FIG. 2 to 5, the user can test the function of the auxiliary backup device 10 in any desired period, preferably conducting the test at least once a month. The testing steps consist of connecting power to the control panel 20, connecting batteries to the auxiliary backup device 10, and pushing to switch off the test switch 40. If the auxiliary device 10 works normally, the alarm device 30 will be fired. Also, if the control panel 20 is triggered, the alarm device 30 will be fired.

In accordance with the present invention, the auxiliary backup device can be installed in any desired concealed location, such as in the ceiling, within a cabinet or closet, in bedroom, or feigning to be a fake socket on wall. Although a burglary or intruder can easily reach and vandalize the burglary control panel by damaging the panel or cutting all the wiring so as to damage the burglary alarm system for stopping the firing of alarm, the auxiliary backup device, once detecting the interruption of the normal power input, by monitoring the voltage of the auxiliary power output from the control panel, will activate its DC power source to supply power to the alarm device. Thus, when the burglary or intruder predicates that the firing of the alarm system will vanish, the alarm device is energized by the auxiliary backup device to continue firing to defer and prevent further damage from the intruder. Furthermore, even the user forgets to switch on the burglary alarm system which no matter is arming or disarming, the alarm device will still be energized once the control panel is destroyed by the burglary or intruder.

I claim:

1. An auxiliary backup device of burglary alarm system, which is connected to an alarm output and an auxiliary power output of a burglary control panel and an alarm device, comprising in combination an electrical circuit having a relay means, a DC power source, a power input, an alarm input, and an alarm output; wherein said power input connecting to said auxiliary power output of said control panel, said alarm input connecting to said alarm output of said control panel, said alarm output connecting to said alarm device;

said relay means comprising an operating coil, said operating coil inducing a normally opened switch and a normally closed switch; in which said operating coil having two terminals connected to said power input, said normally opened switch connecting in series with said alarm input and alarm output which are connected to said alarm output of said control panel and said alarm device respectively; and said DC power source having an power output connected in series with said normally closed switch and said alarm output; so that when said control panel works normally that the voltage of said auxiliary power output of said control panel is high, said normally opened switch is induced to close and said normally closed switch is induced to open; said alarm output of said control panel being connected directly to said input of said alarm device, and that when the power supply of said power input is interrupted, said normally opened switch is opened and said normally closed switch is closed, in which said DC power source energizes said alarm device, wherein said DC power source comprises two 9 V batteries and a power controlling switch device which comprises two high-normal switches, said first and second high-normal switches each having a normal terminal and a high terminal, said first battery having a positive pole connected to said electric wire and said normal terminal of said first switch, said first battery having a negative pole connected to said second switch, said second battery having a position pole connected to said normal terminal of said second switch which is connected to said normally closed switch, said second battery having a negative pole connected to said first switch, said high terminal of said first switch being connected to said high terminal of said second switch, therefore, in normal situation, said two batteries having no supply power, and said alarm device being energized by said control panel, so that when said power input is interrupted, said two batteries are connected to said alarm output and supplies voltage power to said alarm device, and that when said high-normal switches are switched to normal terminals, said two batteries are connected in parallel and their voltage output being in normal stage that said two batteries last longer, and that when said two high-normal switches are switched to high terminals, said two batteries are connected in series and their voltage output being in higher strength that said batteries discharge more quickly.

2. An auxiliary backup device of burglary alarm system, which is connected to an alarm output and an auxiliary power output of a burglary control panel and an alarm device, comprising in combination an electrical circuit having a relay means, a DC power source, a power input, an alarm input, and an alarm output; wherein said power input connecting to said auxiliary power output of said control panel, said alarm input connecting to said alarm output of said control panel, said alarm output connecting to said alarm device;

said relay means comprising an operating coil, said operating coil inducing a normally opened switch and a normally closed switch; in which said operating coil having two terminals connected to said power input, said normally opened switch connecting in series with said alarm input and alarm output which are connected to said alarm output of said control panel and said alarm device respectively, said relay means further comprising a diode connected in parallel with said operating coil, said normally opened switch having a normally opened terminal and a common terminal, said normally closed switch being composed of said common terminal and a normally closed terminal, said alarm input having a negative terminal and said alarm output having a negative terminal connected with each other by an electric wire, said alarm input having a positive terminal connected to said normally opened terminal by a connecting wire, said alarm output having a positive terminal connected to said common terminal by a common wire, said DC power source having an output connected to said normally closed terminal and an input connected with said electric wire; and said DC power source having an power output connected in series with said normally closed switch and said alarm output; so that when said control panel works normally that the voltage of said auxiliary power output of said control panel is high, said normally opened switch is induced to close and said normally closed switch is induced to open; said alarm output of said control panel being connected directly to said input of said alarm device, and that when the power supply of said power input is interrupted, said normally opened switch is opened and said normally closed switch is closed, in which said DC power source energizes said alarm device, and that said DC power source comprises two 9 V batteries and a power controlling switch device which comprises two high-normal switches, said first and second high-normal switches each having a normal terminal and a high terminal, said first battery having a positive pole connected to said electric wire and said normal terminal of said first switch, said first battery having a negative pole connected to said second switch, said second battery having a position pole connected to said normal terminal of said second switch which is connected to said normally closed switch, said second battery having a negative pole connected to said first switch, said high terminal of said first switch being connected to said high terminal of said second switch, therefore, in normal situation, said two batteries having no supply power, and said alarm device being energized by said control panel, so that when said power input is interrupted, said two batteries are connected to said alarm output and supplies voltage power to said alarm device, wherein when said high-normal switches are switched to normal terminals, said two batteries are connected in parallel and their voltage output being in normal stage that said two batteries last longer, and that when said two high-normal switches are switched to high terminals, said two batteries are connected in series and their voltage output being in higher strength that said batteries discharge more quickly.

3. An auxiliary backup device as recited in claim 2, further comprising a jumper circuit which is connected between said power input and said relay means, said jumper circuit comprising a jumper diode and a resistor connected in serial, a capacitor connected in parallel with said power input, thus adapting for 24 V DC or AC power supply.

4. An auxiliary backup device as recited in claim 3, wherein said jumper circuit further comprises a jumper circuit wire connected in parallel with said jumper diode and said resistor for adapting 12 V DC power supply, and when the input power from said control panel is 24 V DC or AC, cut said jumper circuit wire for installation.

5. An auxiliary backup device as recited in claim 4, further comprising a normally closed test switch which is connected between said power output and said relay means for testing said auxiliary backup device's operation and said batteries' strength.

6. An auxiliary backup device as recited in claim 5, in which said auxiliary backup device is disposed in a standard electrical one-gung box.

7. An auxiliary backup device as recited in claim 6, in which said test switch is mounted on said control panel.

* * * * *